US010766060B2

(12) United States Patent
McDonald et al.

(10) Patent No.: US 10,766,060 B2
(45) Date of Patent: Sep. 8, 2020

(54) GROOVED WIRE AND SYSTEM AND METHOD FOR MANUFACTURING GROOVED WIRE

(71) Applicant: Unarco Industries LLC, Wagoner, OK (US)

(72) Inventors: Daniel P. McDonald, Palatine, IL (US); Bobby D. Peters, Wagoner, OK (US)

(73) Assignee: Unarco Industries LLC, Wagoner, OK (US)

( * ) Notice: Subject to any disclaimer, the term of this patent is extended or adjusted under 35 U.S.C. 154(b) by 408 days.

(21) Appl. No.: 15/441,466

(22) Filed: Feb. 24, 2017

(65) Prior Publication Data

US 2017/0246669 A1 Aug. 31, 2017

Related U.S. Application Data

(60) Provisional application No. 62/299,690, filed on Feb. 25, 2016.

(51) Int. Cl.

| | |
|---|---|
| ***B21C 37/04*** | (2006.01) |
| ***B21C 3/08*** | (2006.01) |
| ***B21H 1/20*** | (2006.01) |

(52) U.S. Cl.

CPC ..... *B21C 37/045* (2013.01); *B21C 3/08* (2013.01); *B21H 1/20* (2013.01)

(58) Field of Classification Search

CPC ..... B21C 3/08; B21C 3/12; B21C 37/045; B21H 1/20; B21B 13/12; B21B 13/103; B21B 37/025; B21B 37/024

See application file for complete search history.

(56) References Cited

U.S. PATENT DOCUMENTS 1,940,573 A * 12/1933 Austin ..... B23K 35/0261 219/145.31
4,087,898 A * 5/1978 Linne ..... B21B 1/163 29/527.5

FOREIGN PATENT DOCUMENTS

| | | | | |
|---|---|---|---|---|
| DE | 509511 C | | 10/1930 | |
| EP | 0342403 A2 | * | 11/1989 | ..... B21B 1/16 |
| EP | 0342403 A2 | | 11/1989 | |
| EP | 0903186 A2 | * | 3/1999 | ..... B21B 13/103 |
| EP | 0903186 A2 | | 3/1999 | |

OTHER PUBLICATIONS

May 11, 2017—(WO) International Search Report and Written Opinion—App. PCT/US2017/019364.

* cited by examiner

*Primary Examiner* — Debra M Sullivan
(74) *Attorney, Agent, or Firm* — Banner & Witcoff, Ltd.

(57) ABSTRACT

Apparatuses, systems, and methods for manufacturing grooved wire are provided. A set of rollers may form grooves on an outermost surface of a wire along an axial distance of the wire. The set of rollers may include a first roller and a second roller. The first and second roller may include groove-fabricating portions aligned circumferentially around a radial face of each of the rollers. The first roller and second roller, via the groove-fabricating portions, may form grooves on the outermost surface of the wire along the axial direction of the wire.

19 Claims, 4 Drawing Sheets

GROOVED WIRE AND SYSTEM AND METHOD FOR MANUFACTURING GROOVED WIRE

CROSS-REFERENCE TO RELATED APPLICATIONS

The present application claims priority to U.S. Provisional Patent Application No. 62/299,690, filed Feb. 25, 2016, entitled "Grooved Wire and System and Method for Manufacturing Grooved Wire," which is hereby incorporated by reference in its entirety.

TECHNICAL FIELD

Aspects of the disclosure generally relate to grooved wire and the fabrication of grooved wire. In particular, various aspects of the disclosure relate to apparatuses, systems, and methods for transforming standard round wire into grooved wire.

BACKGROUND

In the metallurgical industry, there is a need for improved apparatuses, systems, and methods for the processing of conventional round wire into alternative, resource-conscious and mechanically viable shapes.

The production of round wire has been a staple in metal manufacturing for centuries. Round wire lends itself advantageously to a spectrum of industries spanning from telecommunications to construction, in part because the symmetric shape exhibits uniform mechanical and electrical properties as the wire is traversed along an axial direction.

However, there is a considerable need for advancement in the apparatuses, systems, and methods dedicated to the manufacture of grooved wire.

SUMMARY

The following presents a simplified summary in order to provide a basic understanding of some aspects of the disclosure. The summary is not an exhaustive overview of the disclosure. It is for illustrative purposes only and is not intended to limit or constrain the detailed description. The following summary merely presents some concepts of the invention in a simplified form as a prelude to the more detailed description provided below.

Aspects of the disclosure relate to improved apparatuses, systems, and methods for the processing of conventional round wire into alternative, resource-conscious and mechanically viable shapes.

In at least some examples described herein, a cassette comprising a set of rollers may be used to transform a standard round wire into a grooved wire. The set of rollers comprised within the cassette may include a first roller and a second roller. The first and second rollers, respectively, may comprise a groove-fabricating portion aligned circumferentially along an outer radial face of each roller. The groove-fabricating portions of the first and second rollers may further comprise a plurality of groove-forming protrusions for forming grooves on an outermost face of the standard round wire. The grooves formed on the standard round wire may be symmetric and may span the length of the wire as traversed along an axial direction of the wire.

In other embodiments, the cassette may include multiple sets of rollers wherein a first set of rollers forms grooves on the wire and a second set of rollers finishes or smooths the grooves formed by the first set of rollers. In still other embodiments, the cassette may include multiple sets of rollers wherein a first set of rollers forms grooves on the wire and a second set of rollers deepens the grooves formed by the first set of rollers The details of these and other aspects of the disclosure are set forth in the accompanying drawings and descriptions below. Other features and advantages of aspects of the disclosure may be apparent from the descriptions and drawings.

BRIEF DESCRIPTION OF THE DRAWINGS

These and other features, aspects, and advantages of the present disclosure will become better understood with regard to the following description, claims, and drawings. The present disclosure is illustrated by way of example, and not limited by, the accompanying figures in which like numerals indicate similar elements.

DETAILED DESCRIPTION

Figure 1B:
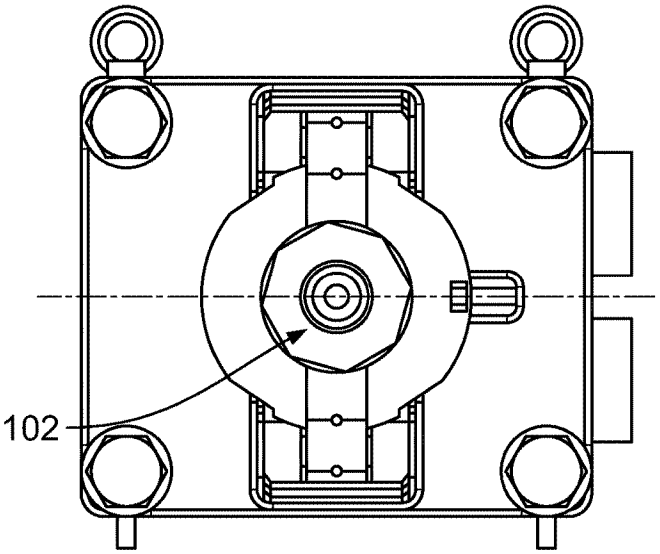
FIG. 1B is a front view of an embodiment of a cassette utilized during the manufacture of grooved wire according to aspects of this disclosure.

While this invention is susceptible of embodiments in many different forms, there are shown in the drawings and will herein be described in detail exemplary embodiments of the invention with the understanding that the present disclosure is to be considered as an exemplification of the principles of the invention and is not intended to limit the broad aspects of the disclosure to the embodiments illustrated. It is to be understood that other embodiments may be utilized, and structural and functional modifications may be made, without departing from the scope and spirit of the present disclosure.

In the following description of the various embodiments, reference is made to the accompanying drawings, which form a part hereof, and in which is shown by way of illustration, various embodiments of the disclosure that may be practiced. It is to be understood that other embodiments may be utilized.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "upward," "downward," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale. Further, when the same reference number appears in more than one drawing, that reference number is used consistently in this specification and the drawings to refer to the same or similar parts throughout.

The following, in accordance with various aspects of the disclosure, provides apparatuses, systems, and methods for transforming standard round wire into grooved wire.

Figure 1A:
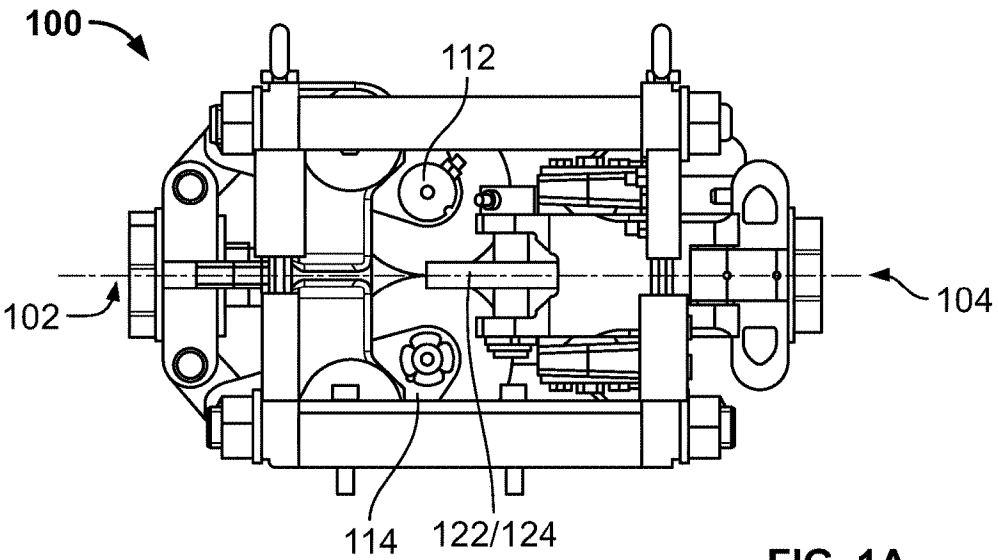
FIG. 1A is a side view of an embodiment of a cassette utilized during the manufacture of grooved wire according to aspects of this disclosure.
Figure 1C:
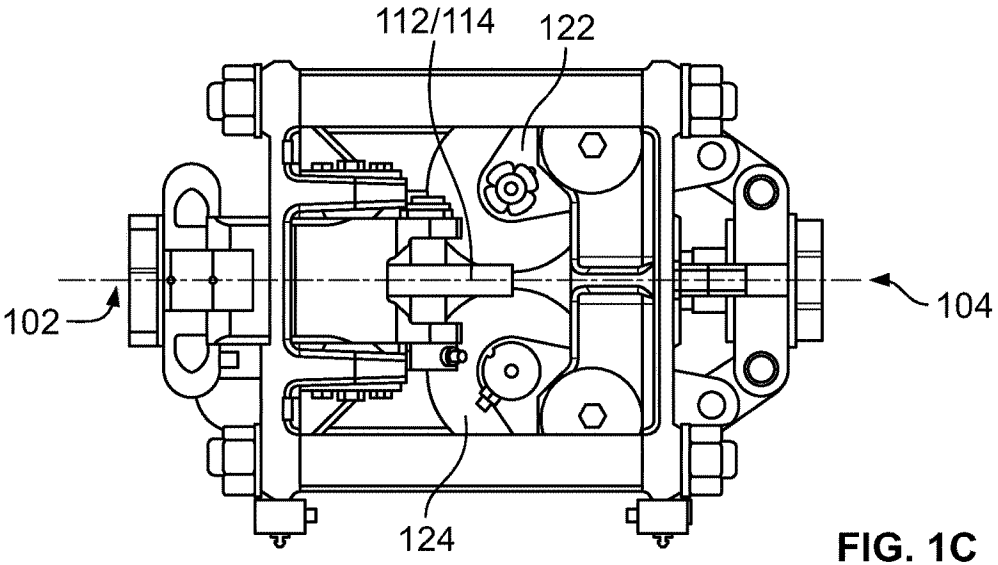
FIG. 1C is a top view of an embodiment of a cassette utilized during the manufacture of grooved wire according to aspects of this disclosure.

FIGS. 1A-1C illustrate various perspective views of an embodiment of a cassette utilized herein for the manufacture of grooved wire. Cassette 100 includes an upstream entry point 102 through which standard round wire enters, and a downstream exit point 104 through which transformed grooved wire exits. In certain embodiments, upstream entry point 102 and downstream exit point 104 can be interchangeable depending on the orientation of cassette 100. Furthermore cassette 100, via upstream entry point 102 and downstream exit point 104, can accommodate and process a variety of wire types and wire dimensions. For instance, wire types may include iron, steel, titanium, aluminum, copper, brass, and the like, as well as combinations thereof, and wire dimensions may include a variety of wire diameters, lengths, and shapes.

Cassette 100 may also include a plurality of sets of rollers (e.g., 112 & 114, 122 & 124). The sets of rollers may include upstream rollers (112, 114) positioned towards upstream entry point 102 and downstream rollers (122, 124) positioned towards downstream exit point 104. In some instances, the upstream and downstream rollers may be interchangeable and not dependent on location relative to upstream entry point 102 or downstream exit point 104. In other embodiments, cassette 100 may be operable with only one set of rollers (i.e., upstream rollers or downstream rollers). In such embodiments, the upstream or downstream rollers may be a single set of grooving rollers described in further detail below, and may function to transform the round wire into grooved wire in the manner as discussed herein. However, the upstream rollers and downstream rollers may also be operable in tandem to transform the round wire into grooved wire. When operated in tandem, the upstream rollers and downstream rollers may be grooving rollers and finishing rollers, respectively. In some embodiments the rollers 112, 114 may force wire through the cassette while in other embodiments the wire may be forced through the cassette by another mechanism.

The upstream set of rollers (112, 114) may be a set of grooving rollers and may include a first grooving roller 112 and a second grooving roller 114. The first grooving roller 112 and the second grooving roller 114 may be radially spaced 180 degrees apart and may be separated by a first distance corresponding to a length of a groove formed on the round wire. In other embodiments, the first grooving roller 112 and the second grooving roller 114 may not be separated by a first distance, and may instead be positioned relatively flush with each other.

The first grooving roller 112 may be configured to rotate in a first direction (e.g. clockwise, counterclockwise), and the second grooving roller 114 may be configured to rotate in a second direction opposite the first direction (e.g., counterclockwise, clockwise). The respective rotation of the first and second grooving rollers may draw, pull, and/or otherwise force the round wire into cassette 100 via upstream entry point 102.

The downstream set of rollers (122, 124) may be a finishing set of rollers and may include a first finishing roller 122 and a second finishing roller 124. Like the first grooving roller 112 and the second grooving roller 114, the first finishing roller 122 and the second finishing roller 124 may be radially spaced 180 degrees apart. Additionally, the first finishing roller 122 and the second finishing roller 124 may be offset by 90 degrees from the radial positioning of the first grooving roller 112 and the second grooving roller 114. For example, if the first grooving roller 112 and the second grooving roller 114 occupy the 0 and 180 degree marks, the first finishing roller 122 and the second finishing roller 124 may occupy the 90 and 270 degree marks. In some embodiments, the radial offset between the set of grooving rollers and the set of finishing rollers may be greater or less than 90 degrees. Like the first grooving roller 112 and the second grooving roller 114, the first finishing roller 122 and the second finishing roller 124 may be spaced apart by the first distance, or may be positioned relatively flush with each other.

Furthermore, the first finishing roller 122 may be configured to rotate in a first direction (e.g. clockwise, counterclockwise), and the second finishing roller 124 may be configured to rotate in a second direction opposite the first direction (e.g., counterclockwise, clockwise). The rotation of the first and second finishing rollers may push, expel, and/or otherwise force the round wire out of cassette 100 via downstream exit point 104. The first finishing roller 122 and the second finishing roller 124 may be configured to rotate in a direction corresponding to the direction of rotation of the first grooving roller 112 and second grooving roller 114, respectively. For example, if the first grooving roller 112 is rotating counterclockwise, the first finishing roller 122 may also rotate counterclockwise.

As stated above, in certain embodiments, the set of upstream rollers (e.g., the set of grooving rollers) and the set of downstream rollers (e.g., the set of finishing rollers) may be implemented in cassette 100 in tandem, or independently. In such an embodiment where only a single set of rollers is used, the set of rollers may be configured as grooving rollers and function to form grooves on the round wire.

As described in further detail below, each of the rollers comprised within cassette 100 (e.g., first grooving roller 112, second grooving roller 114, first finishing roller 122, second finishing roller 124) may include a groove-fabricating and/or wire-finishing portion depending on the function of the roller. For example, first grooving roller 112 and second grooving roller 114 may include a first groove-fabricating portion and a second groove-fabricating portion, respectively, for forming grooves on an outermost surface of the round wire as it is drawn, pulled, and/or otherwise forced into cassette 100. Similarly, first finishing roller 122 and second finishing roller 124 may include a first wire-finishing portion and a second wire-finishing portion, respectively, for smoothing and/or finishing the grooves made by the first and second grooving rollers on the outermost surface of the round wire as it is pushed, expelled, and/or otherwise forced out of cassette 100.

Figure 2A:
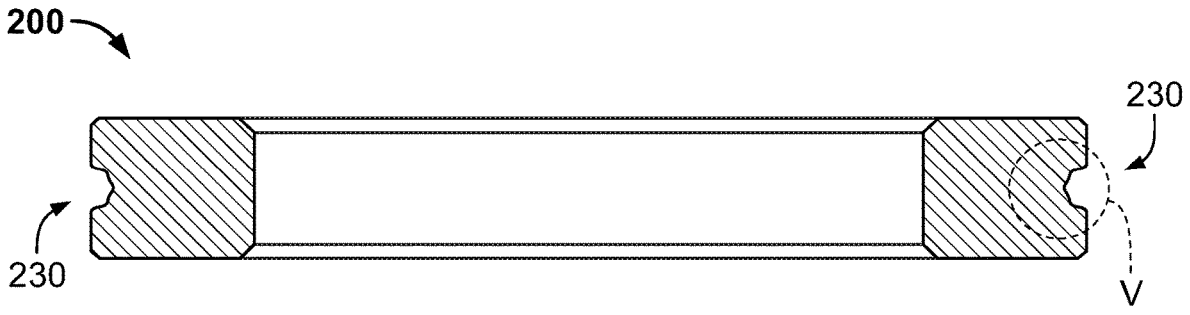
FIG. 2A is a cross-sectional view of a roller utilized during the manufacture of grooved wire according to aspects of this disclosure.
Figure 2B:
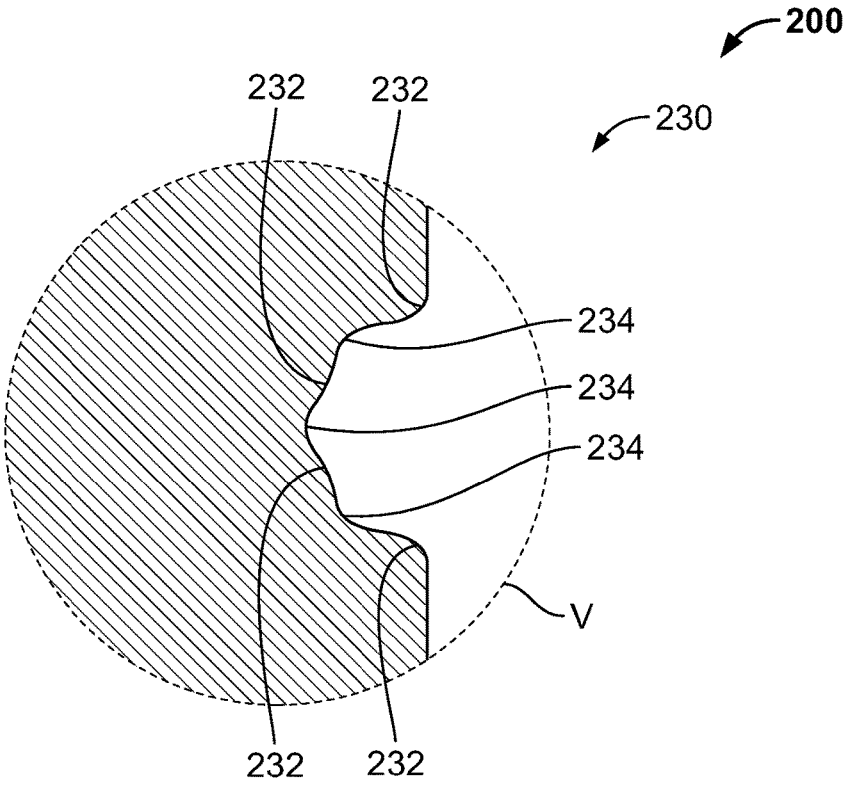
FIG. 2B is an enlarged view of section V of FIG. 2A.

FIGS. 2A & 2B illustrate a cross-sectional view of an embodiment of a roller and an enlarged section of a specific portion of the roller, respectively. Roller 200, as described in regards to FIGS. 2A & 2B, may be any of the first grooving roller 112, second grooving roller 114, first finishing roller 122, and second finishing roller 124, and may include any of the above mentioned features and functionality as the first grooving roller 112, second grooving roller 114, first finishing roller 122, and second finishing roller 124. Furthermore, first grooving roller 112, second grooving roller 114, first finishing roller 122, and second finishing roller 124 may include any of the features and functionality described herein with regards to roller 200.

Roller 200 may be fabricated in a variety of materials and dimensions. For example, roller 200 may be made out of steel, tungsten carbide, or any material of the like, and may come in a variety of dimensions in order to accommodate the transformation of the round wire into grooved wire.

As shown in FIG. 2A, roller 200 may include a groove-fabricating or wire-finishing portion 230 aligned circumferentially around a radial face of the roller. When roller 200 is a first grooving roller 112 or a second grooving roller 114, portion 230 is a groove-fabricating portion 230. When roller 230 is a first finishing roller 122 or a second finishing roller 124, portion 230 is a wire-finishing portion 230. In certain embodiments, the groove-fabricating portion and wire-finishing portion may be substantially similar. For example, the groove-fabricating portion 230 of first grooving roller 112 and second grooving roller 114 may be identical in size and shape to that of the wire-finishing portion 230 of first finishing roller 122 and second finishing roller 124. In other embodiments, the groove-fabricating portion and wire-finishing portion may be different. For example, the groove-fabricating portion 230 of first grooving roller 112 and second grooving roller 114 may be larger or smaller than the wire-finishing portion 230 of first finishing roller 122 and second finishing roller 124. Such embodiments may serve to deepen or otherwise change the shape of grooves in the wire which may also act to further elongate the wire as it passes through the cassette.

The groove-fabricating or wire-finishing portion 230 may be oriented so as to engage the round wire W perpendicular to the axial direction of the wire. In such a configuration, the groove-fabricating portion 230 may be able to form grooves 302 and ridges 304 on an outermost surface of the wire along the axial or longitudinal direction of the wire. Furthermore, groove-fabricating portion 230 may elongate the round wire as grooves are formed.

Similarly, wire-finishing portion 230 may be able to finish, smooth, make symmetric, or change the shape of the grooves 302 and ridges 304 formed on the outermost surface of the wire along the axial or longitudinal direction of the wire. Such finishing as caused by wire-finishing portion 230 may also elongate the grooved wire.

As shown in greater detail in FIG. 2B, groove-fabricating or wire-finishing portion 230 may comprise a plurality of groove-forming projections 232 and groove-forming depressions 234. In certain embodiments, the groove-forming projections 232 and groove-forming depressions 234 may be disposed in a sinusoidal shape around the circumference of groove-fabricating or wire-finishing portion 230. As shown in FIG. 2B, the groove-forming projections 232 may have convex shape and the groove-forming depressions 234 may have a concave shape. In embodiments, there may be at least four groove-forming projections (e.g., peaks) and at least three groove-forming depressions (e.g., troughs). Although the groove-forming projections 232 and groove-forming depressions 234 may have differing sizes based on the diameter of the wire being grooved and the desired sizes of the grooves, one exemplary wire cross-section is shown in FIGS. 2A and 2B. In one embodiment, the groove-forming depressions 234 may have a radius of about 0.038 in. or may be in the range of about 0.026 in. to about 0.050 in. And in an embodiment, the groove-forming projections 232 may have a radius of about 0.076 in. or may be in the range of about 0.052 in. to about 1.00 in. The size of the groove-forming projections 232 and the groove-forming depressions 234 may be the same or similar to the size of the grooves 302 and ridges 304 of the wire, the sizes of which are discussed in more detail below.

In other embodiments, there may be greater or fewer groove-forming projections 232 and groove-forming depressions 234. The groove-forming projections 232 and groove-forming depressions 234 may be in a rounded, square, or triangular shape and may serve to form grooves of a similar shape on the round wire.

Figure 3A:
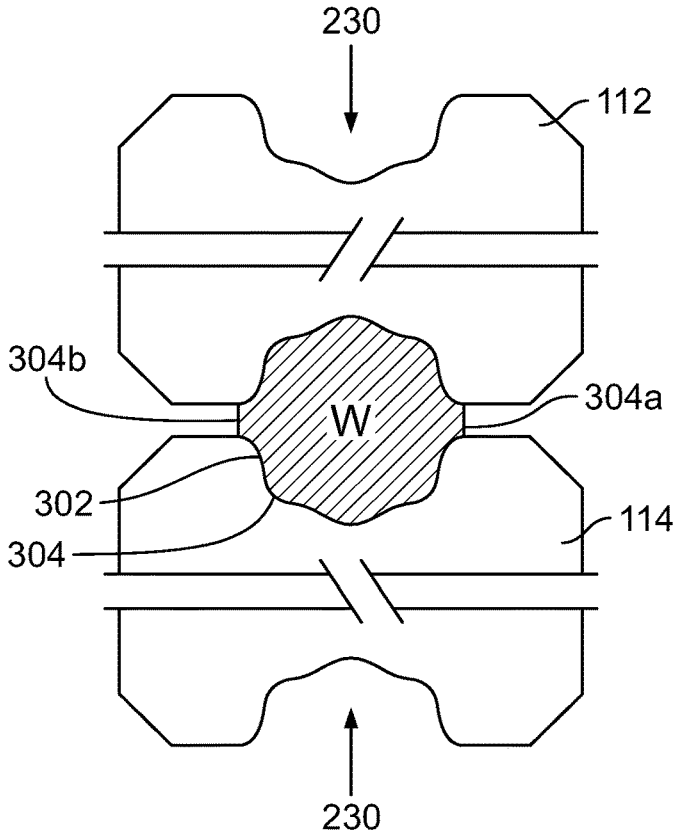
FIG. 3A is a cross-sectional view of a wire engaged by a set of upstream rollers according to aspects of this disclosure.
Figure 3B:
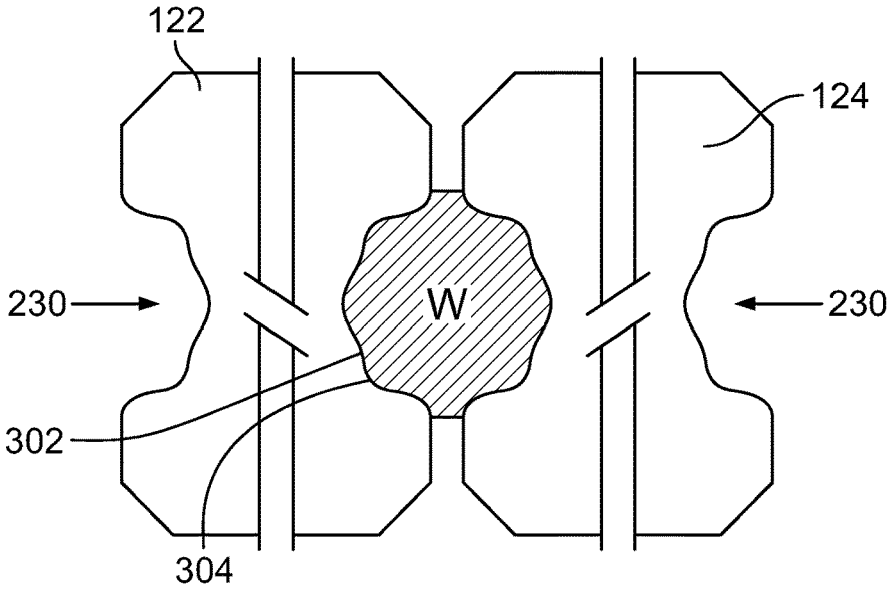
FIG. 3B is a cross-sectional view of a wire engaged by a set of downstream rollers according to aspects of this disclosure.

In the embodiment shown in FIGS. 3A and 3B, wire W may be transformed into grooved wire through engagement with the set of upstream/grooving rollers (e.g., first grooving roller 112 and second grooving roller 114) and the set of downstream/finishing rollers (e.g., first finishing roller 122 and second finishing roller 124). In such an embodiment, wire W may first engage with the set of upstream/grooving rollers 112, 114 as shown in FIG. 3A. The first grooving roller 112 and second grooving roller 114 may be a pair of identical rollers 200 radially spaced 180 degrees apart and separated by a distance corresponding to a length of a groove formed on wire W. The first grooving roller 112 and second grooving roller 114 may be configured to form grooves on wire W via a first and second groove-fabricating portions 230. The grooves formed on wire W by the first grooving roller 112 and second grooving roller 114 via the first and second groove-fabricating portions 230, respectively, may be radially spaced apart for a total of eight grooves. In such an instance, the first grooving roller 112 via the first groove-fabricating portion 230 may form four grooves 302 on wire W and the second grooving roller 114 via the second groove-fabricating portion 230 may also form four grooves 302 on wire W. The rollers 112, 114 may also form corresponding ridges 304, two of which 304*a* and 304*b* in FIG. 3A) are formed between the rollers 112, 114. In some embodiments the grooves 302 may be symmetrically radially spaced around the wire, as shown in FIG. 3A, but in other embodiments, the grooves 302 may not be symmetrically spaced. In some embodiments, wire W may elongate during the groove forming process via engagement with the first grooving roller 112 and the second grooving roller 114.

After engaging the set of upstream/grooving rollers 112, 114, wire W may subsequently engage the set of downstream/finishing rollers 122, 124 as shown in FIG. 3B. The first finishing roller 122 and second finishing roller 124 may be a pair of identical rollers 200 radially spaced 180 degrees apart and separated by a distance corresponding to a length of a groove formed on wire W. The set of downstream/finishing rollers may be radially offset from the set of upstream/grooving rollers. The first finishing roller 122 and second finishing roller 124 may finish or smooth the grooves formed in wire W via a first and second finishing portions 230, respectively. In some embodiments, wire W may elongate during the finishing process via engagement with the first finishing roller 122 and the second finishing roller 124.

As stated above, in other embodiments, wire W may be transformed into grooved wire through engagement with only one set of rollers. In such an instance, the set of rollers may be considered to be a set of upstream/grooving rollers (e.g., first grooving roller 112 and second grooving roller 114).

Figure 4:
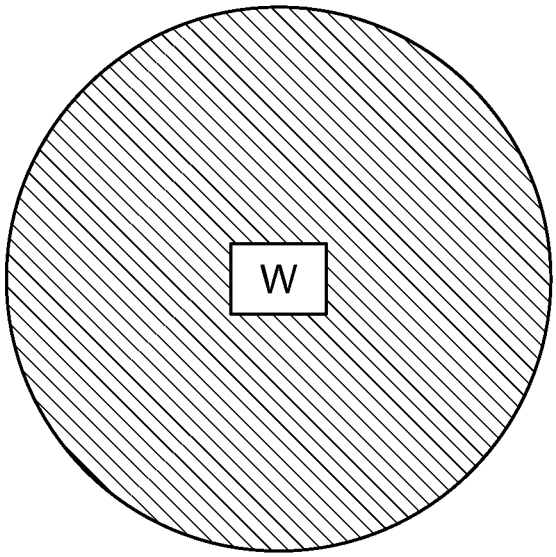
FIG. 4 is a cross-sectional view of a wire before engaging with a cassette and rollers comprised therein according to aspects of this disclosure.
Figure 5:
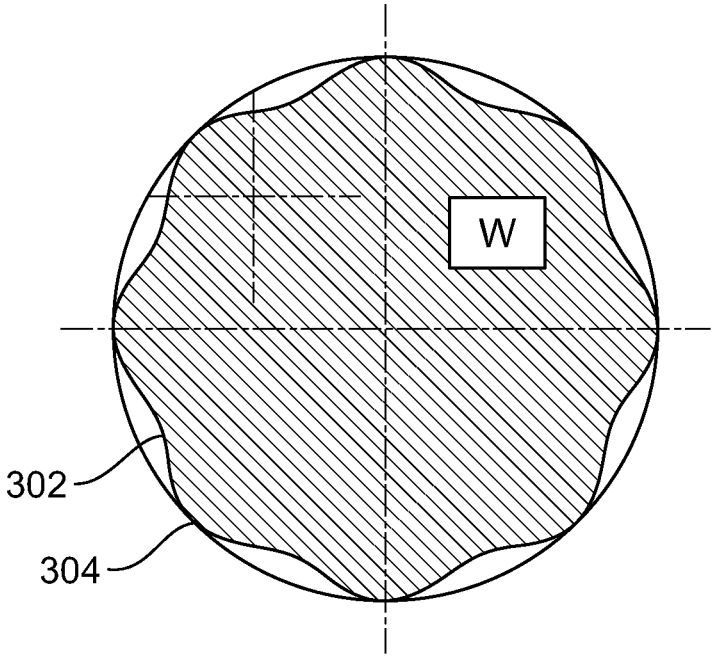
FIG. 5 is a cross-sectional view of a wire after engaging with a cassette and rollers comprised therein according to aspects of this disclosure.

FIGS. 4 and 5 show the transformation of wire W from standard round wire (FIG. 4) to a grooved wire (FIG. 5). As shown, for example, in FIG. 5, grooves 302 and ridges 304 may be created by rollers 112, 114 and/or 122, 124 as described above. As shown in FIG. 5, the outside diameter of the wire may be about 0.2437 in. or in the range of about 0.2 in. to about 0.3 in., however, as described above, other sizes may be used. The ridges 304 may have a radius of about 0.038 in. or may be in the range of about 0.026 in. to about 0.050 in. The grooves 302 may have a radius of about 0.076 in. or may be in the range of about 0.052 in. to about 1.00 in. The grooves 302 may have a depth of about 0.011 inches or in the range of about 0.007 in. to about 0.015 in. The dimensional ranges with regard to the grooves 302 and ridges 304 may change based on the size of the diameter of the wire. Table 2 below includes ratios of dimensions that may be used on wire of other sizes.

TABLE 2

| | |
|---|---|
| Ratio of Ridge Radius to Wire Diameter | 0.156 or about 0.095-0.203 |
| Ratio of Groove Radius to Wire Diameter | 0.312 or about 0.190-0.405 |
| Ratio of Groove Depth to Wire Diameter | 0.045 or about 0.027-0.059 |

Wires W formed as described above may have certain advantages. For example, wires manufactured as described above may be about 8.6% lighter than a wire having the same outer diameter, or about 7% to about 10% lighter than a wire having the same outer diameter. This may reduce shipping costs and material costs and also may put a lower load on equipment using the wire. Additionally, arrangements discussed above may aid in reducing the complexity of wire grooving apparatuses by utilizing fewer rotational components arranged in serviceable orientations. The arrangements described herein include various mechanical components such as cassettes and rollers for forming grooves on an outermost surface of a round wire along an axial direction of the wire. The components may be added, omitted, rearranged, and/or modified without departing from the invention. Grooved wire as discussed above may have many uses including for example in shopping carts, baskets, shelving, hanging hooks, dishwasher racks, refrigerator racks, cooking racks, grills racks, coat hangers, rebar, and many other uses.

The foregoing descriptions of the disclosure have been presented for purposes of illustration and description. They are not exhaustive and do not limit the disclosure to the precise form disclosed. Modifications and variations are possible in light of the above teachings or may be acquired from practicing of the disclosure.

What is claimed is:

1. A device for forming grooves along an axial direction of a wire, said device comprising:

a set of grooving rollers, the set of grooving rollers comprising:

a first grooving roller configured to rotate in a first direction and comprising a first groove-fabricating portion aligned circumferentially around a radial face of the first grooving roller and oriented in a third direction perpendicular to the axial direction of the wire;

a second grooving roller configured to rotate in a second direction opposite the first direction and comprising a second groove-fabricating portion aligned circumferentially around a radial face of the second grooving roller and oriented in the third direction perpendicular to the axial direction of the wire;

wherein the first groove-fabricating portion of the first grooving roller and the second groove-fabricating portion of the second grooving roller are configured to form grooves on an outermost surface of the wire along the axial direction of the wire, wherein the first groove-fabricating portion of the first grooving roller extends substantially halfway along the outermost face of the wire, wherein the second groove-fabricating portion of the second grooving roller extends substantially halfway along the outermost face of the wire, and wherein the first fabricating portion of the first grooving roller and the second groove-fabricating portion of the second grooving roller substantially surround a circumference of the wire; and a set of finishing rollers positioned downstream of the set of grooving rollers, the set of finishing rollers comprising:

a first finishing roller configured to rotate in the first direction and comprising a first wire-finishing portion aligned circumferentially around a radial face of the first finishing roller and oriented in the third direction perpendicular to the axial direction of the wire;

a second finishing roller configured to rotate in the second direction opposite the first direction and comprising a second wire-finishing portion aligned circumferentially around a radial face of the second finishing roller and oriented in the third direction perpendicular to the axial direction of the wire;

wherein, via the first wire-finishing portion and the second wire-finishing portion, the first finishing roller and the second finishing roller are configured to smooth the grooves on the outermost surface of the wire formed by the first grooving roller and the second grooving roller.

2. The device of claim 1, wherein the first grooving roller and the second grooving roller are further configured to elongate the wire via the first groove-fabricating portion and the second groove-fabricating portion.

3. The device of claim 1, wherein the first groove-fabricating portion and the second groove-fabricating portion comprise groove-forming projections, and wherein the grooves fabricated on the outermost surface of the wire along the axial direction are produced by the groove-forming projections.

4. The device of claim 3, wherein the first groove-fabricating portion and the second groove-fabricating portion comprise an equal number of groove-forming projections.

5. The device of claim 4, wherein the first groove-fabricating portion and the second groove-fabricating portion comprise an even number of groove-forming projections.

6. The device of claim 4, wherein the groove-forming projections form symmetric grooves on the outermost surface of the wire along the axial direction of the wire.

7. The device of claim 3, wherein the groove-forming projections are disposed in a sinusoidal shape around a circumference of the first groove-fabricating portion and the second groove-fabricating portion.

8. The device of claim 7, wherein the sinusoidal shape comprises at least four peaks and at least three troughs.

9. The device of claim 8, wherein the peaks and the troughs are in a square, triangular, or rounded shape.

10. The device of claim 9, wherein the first grooving roller is radially spaced 180 degrees from the second grooving roller.

11. The device of claim 10, wherein the first grooving roller is spaced apart from the second grooving roller by a first distance, the first distance corresponding to a length measured from a first groove formed depression formed on the wire to a second groove formed depression on the wire.

12. The device of claim 1, wherein the set of finishing rollers are radially offset from the set of grooving rollers.

13. The device of claim 12, wherein the first finishing roller is radially space 180 degrees from the second finishing roller.

14. The device of claim 1, wherein the first wire-finishing portion of the first finishing roller corresponds to the first groove-fabricating portion of the first grooving roller, and the second wire-finishing portion of the second finishing roller corresponds to the second groove-fabricating portion of the second grooving roller.

15. A device for forming grooves along an axial direction of a wire, said device comprising:

a set of grooving rollers, the set of grooving rollers comprising:

a first grooving roller configured to rotate in a first direction and comprising a first groove-fabricating portion aligned circumferentially around a radial face of the first grooving roller and oriented in a third direction perpendicular to the axial direction of the wire;

a second grooving roller configured to rotate in a second direction opposite the first direction and comprising a second groove-fabricating portion aligned circumferentially around a radial face of the second grooving roller and oriented in the third direction perpendicular to the axial direction of the wire; and a set of finishing rollers positioned downstream of the set of grooving rollers, the set of finishing rollers comprising:

a first finishing roller configured to rotate in the first direction and comprising a first wire-finishing portion aligned circumferentially around a radial face of the first finishing roller and oriented in the third direction perpendicular to the axial direction of the wire;

a second finishing roller configured to rotate in the second direction opposite the first direction and comprising a second wire-finishing portion aligned circumferentially around a radial face of the second finishing roller and oriented in the third direction perpendicular to the axial direction of the wire; and wherein the first groove-fabricating portion of the first grooving roller extends substantially halfway along an outermost face of the wire, wherein the second groove-fabricating portion of the second grooving roller extends substantially halfway along the outermost face of the wire, and wherein the first fabricating portion of the first grooving roller and the second fabricating portion of the second grooving roller substantially surround a circumference of the wire to form grooves on the outermost surface of the wire along the axial direction of the wire;

wherein, via the first wire-finishing portion and the second wire-finishing portion, the first finishing roller and the second finishing roller are configured to smooth the grooves on the outermost surface of the wire formed by the first grooving roller and the second grooving roller; and wherein a ratio of a depth of the grooves to a diameter of the wire is about 0.027-0.059.

16. The device of claim 15, wherein the first groove-fabricating portion and the second groove-fabricating portion comprise groove-forming projections, wherein the grooves fabricated on the outermost surface of the wire along the axial direction are produced by the groove-forming projections;

wherein the first wire-finishing portion and the second wire-finishing portion comprise wire-finishing projections; and wherein the grooves on the outermost surface of the wire along the axial direction are smoothed by the wire-finishing projections.

17. A device for forming grooves along an axial direction of a wire, said device comprising:

a set of upstream rollers positioned towards an upstream entry point of the device, wherein the set of upstream rollers comprises a first roller and a second roller, wherein the first roller and the second roller comprise a groove-fabricating portion;

a set of downstream rollers positioned towards a downstream exit point of the device, wherein each downstream roller of the set of downstream rollers comprises a wire-finishing portion;

wherein the first roller groove-fabricating portion and the second roller groove-fabricating portion comprise a groove-forming projection configured to form grooves on an outermost surface of the wire along the axial direction of the wire and wherein the wire-finishing portion is configured to smooth the grooves formed on the outermost surface of the wire by the first roller groove-fabricating portion and the second roller groove-fabricating portion;

wherein the first roller groove-fabricating portion and the second roller groove-fabricating portion in the set of upstream rollers each extend substantially halfway around a circumference of the surface of the wire substantially covering the circumference of the wire; and wherein the wire-finishing portion of the set of downstream rollers extend substantially halfway around a circumference of the surface of the wire substantially covering the circumference of the wire.

18. The device of claim 17, wherein the groove-fabricating portion comprises an equal number of groove-forming projections and wherein the groove-forming projections are disposed in a sinusoidal shape around a circumference of the groove-fabricating portion.

19. The device of claim 17, wherein a ratio of a depth of the grooves to a diameter of the wire is about 0.027-0.059.

* * * * *